US005369329A

United States Patent [19]

Austad et al.

[11] Patent Number: 5,369,329

[45] Date of Patent: Nov. 29, 1994

[54] SHORT ARC LAMP ELECTRODE ROD SUPPORTS

[75] Inventors: Helge Austad, Lebanon; Thomas Gaven, Summit Township, Union County; Ronald A. Mack, Kenilworth, all of N.J.

[73] Assignee: Canrad, Inc., Newark, N.J.

[21] Appl. No.: 958,767

[22] Filed: Oct. 9, 1992

[51] Int. Cl.[5] ..... H01J 1/96

[52] U.S. Cl. ..... 313/284; 313/251; 313/285; 313/623

[58] Field of Search ..... 313/284, 251, 252, 285, 313/335, 623, 632; 444/26, 29, 32

[56] References Cited

U.S. PATENT DOCUMENTS

| | | | |
|---|---|---|---|
| 2,562,887 | 8/1951 | Beese | 313/25 |
| 2,749,461 | 6/1956 | Hierholzer et al. | 313/25 |
| 2,962,615 | 11/1960 | Anton | 313/284 |
| 3,211,941 | 10/1965 | Sanden et al. | 313/284 |
| 3,250,941 | 5/1966 | Wilson et al. | 313/632 |
| 3,497,752 | 2/1970 | Peterson | 313/285 |
| 3,715,615 | 2/1973 | Lavering | 313/285 |
| 4,463,281 | 7/1984 | Triebel et al. | 313/335 |
| 4,463,281 | 7/1984 | Triebel et al. . | |
| 4,559,472 | 12/1985 | Triebel et al. . | |

FOREIGN PATENT DOCUMENTS

| | | | |
|---|---|---|---|
| 2106312 | 4/1983 | United Kingdom | 313/623 |

*Primary Examiner*—Donald J. Yusko
*Assistant Examiner*—Vip Patel
*Attorney, Agent, or Firm*—Kenneth P. Glynn; Stephen J. Driscoll

[57] ABSTRACT

The present invention involves a short arc discharge lamp having a quartz envelope with a bulb and a plurality of arms having a specified cross-section, and wherein one or more electrode rods are supported within the lamp arms for specific alignment. Support elements for the electrode rods are made of high temperature metal and have a flat central portion with a central orifice of sufficient dimension to permit one of the electrode rods to pass into the central orifice, and have at least two legs, and preferably four legs, radially extending from the flat central portion. The legs have outer portions terminating with pods formed at substantially right angles to the flat central portion of the support element, the legs being of sufficient length to fit the support element within a specified cross-section of the envelope arms so as to contact an inside surface of the envelope arms with the pods. There is also provided means for securing the support elements within the envelope arms.

19 Claims, 4 Drawing Sheets

SHORT ARC LAMP ELECTRODE ROD SUPPORTS

BACKGROUND OF THE INVENTION

1. Field of the Invention

The present invention is directed to support elements for short arc lamp electrode rods. More specifically, such support elements of the present invention are metal and provide significant passage areas for circulation of gas within the arms of the lamp.

2. Prior Art Statement

Short arc lamps have been in use for many years and typically involve xenon or other gas within a quartz glass envelope with an anode and cathode separated by a gap across which an arc passes during use. Xenon is particularly useful because it emits a daylight-like discharge.

The electrodes are attached to electrode rods in opposite positions to each other and these rods extend into quartz arms for contact with electrical connectors. The electrode rods are supported so as to be centrally located axially within the quartz arms, and so as to align the electrodes with one another.

U.S. Pat. No. 4,559,472 describes a discharge lamp or arc lamp with specified support element structures for the electrode rods (referred to as "elongated electrodes"). The high pressure arc lamp described has a quartz glass enclosure defining a discharge space and quartz arms extending away from the discharge space are provided with elongated electrodes (assemblies) extending respectively through the quartz arms. These electrode assemblies carry respective electrodes at their inner ends and the electrode assemblies are sealed hermetically to the respective envelope portion. In order to support the electrodes within the envelope, respective support elements are fitted around the electrodes in spaced relation to the envelope and quartz arms. Means including a respective resilient element engaging each support member, are provided to hold the support elements in their axial position around the respective electrode assemblies. The resilient elements are each held between the respective electrode and the inner surface of the respective support element to continuously urge the axially outer surface of the support element resiliently against the respective inner diameter of the quartz arms.

Unfortunately, the lamp described in U.S. Pat. No. 4,559,472 above retains the gases within the bulbous portions or bulb of the envelope and the sputtering and blackening which occurs limits the illumination and the life of the lamp.

U.S. Pat. No. 4,463,281 describes another arc lamp wherein the electrode rods are supported by spring biased quartz plugs. These plugs are of less mass than the previously described prior art electrode supports and are spring loaded toward the center, with notches or openings cut out for gas to flow through. However, these spaces do not permit or induce significant enough gas flow to substantially reduce the negative sputtering effects described above. In fact, larger cut outs cannot be made without causing or risking cracking or shattering of the glass supports.

Thus, while various supports have been developed for short arc lamp electrode rods, none suggest or teach the present invention metallic supports with their configurations and advantages described herein.

SUMMARY OF THE INVENTION

The present invention involves a short arc discharge lamp having a quartz envelope with a bulb and a plurality of arms having a specified cross-section, and wherein one or more electrode rods are supported within the lamp arms for specific alignment. Support elements for the electrode rods are made of high temperature metal and have a flat central portion with a central orifice of sufficient dimension to permit one of the electrode rods to pass into the central orifice, and have at least two legs, and preferably four legs, radially extending from the flat central portion. The legs have outer portions terminating with pods formed at substantially right angles to the flat central portion of the support element, the legs being of sufficient length to fit the support element within a specified cross-section of the envelope arms so as to contact an inside surface of the envelope arms with the pods. There is also provided means for securing the support elements within the envelope arms. It is preferred that one or more of the legs of the support element form an angle with the flat central portion upwardly at less than a predetermined angle, e.g. less than 30°, and one or more of the legs of the support element form an angle with the flat central portion downwardly at less than a predetermined angle. The predetermined angle may vary depending upon the size of the side arm and or the weight of electrode.

BRIEF DESCRIPTION OF THE DRAWINGS

The present invention is more fully understood when the specification herein is taken in conjunction with the drawings appended hereto. They are as follows.

DETAILED DESCRIPTION OF THE PRESENT INVENTION

The present invention is directed to an improved short arc discharge lamp which has one or more support elements to hold electrode rods in their proper aligned positions within the lamp envelope arms. Thus, it is an object of the present invention to arrange the support element in such a way that it can be held in its proper axial position relatively simply.

Briefly, in accordance with the present invention, a short arc discharge lamp having a quartz envelope defining a discharge space and envelope portions extending away from the discharge space, referred to as "arms", is provided with electrode rods extending respectively through the envelope arms. These electrode rods carry at their inner end portions respective electrodes facing one another within the discharge space, and conventional means are used for interconnecting outer end portions of the electrode rods and respective envelope arms for sealing the electrode rods hermetically within the envelope portions. In order to support the electrode rods within the envelope arms, respective support elements are used with each electrode rod in spaced relation to the envelope arms, and resilient retaining or locking means are provided which resiliently engage each support element, for holding the support elements in their axial positions around respective electrode rods.

Figure 1:
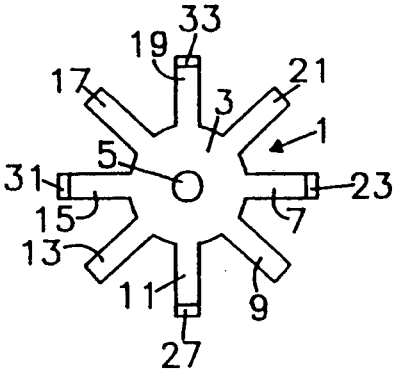
FIG. 1 shows a top view of a single spider support element of the present invention.

Referring now to the Figures, there is shown in FIG. 1 a top view of a single spider support element of the present invention. This support element is configured to receive a cylindrical electrode rod but could readily be adapted to receive an electrode rod of a cross-section other than circular. However, since electrode rods for short arc discharge lamps are typically cylindrical, the support elements described herein are shown as cylindrical but should not be viewed to be limited as such. Thus, FIG. 1 shows a top view of support element 1, having a flat central portion 3 and a central orifice 5 of sufficient diameter to receive an electrode rod therethrough. Support element 1 has legs 7, 9, 11, 13, 15, 17, 19 and 21 as shown. Fewer legs could be utilized and as few as three legs would sufficiently support a typical electrode rod for short arc discharge lamps. These legs radially extend from the central orifice 5 and flat central portion 3, as shown. They are cut in generally rectangular fashion, but any configuration could be used without exceeding the scope of the invention. As can be seen from the top view of support element 1 shown in FIG. 1, a significant open space area is established between each leg and this will become important for gaseous flow and various advantages described more fully below. The support elements of the present invention should be constructed of high temperature metal, that is, metal which will not melt or distort at typical short arc discharge lamp envelope arm temperatures, such as molybdenum or molybdenum alloys, tontalum, titanium, etc.

Figure 2:
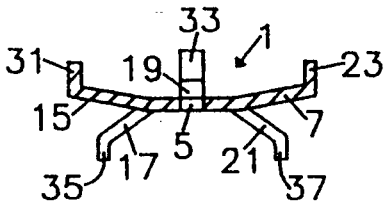
FIG. 2 shows a side cut view of the support element shown in FIG. 1.

FIG. 2 shows a cut side view of support element 1 which is shown in FIG. 1 and identical parts are identically numbered. In this view taken in conjunction with FIG. 1, it can be seen that the legs radially extend upwardly and downwardly from the flat central portion to form an angle with the flat central portion. In one preferred embodiment, this angle does not exceed 30°. FIG. 2 also shows that the various legs have pods such as upwardly extending pods 23, 31 and 33 as well as downwardly extending pods 35 and 37. These are adapted to be indirect contact with the inner surfaces of an arm of an envelope of a discharge lamp of the present invention.

The support element 1 shown in FIG. 1 is a "single spider" support element and these may be used with electrode rods for support within short arc discharge lamps with some means for securing the support element within an envelope arm. A single spider support element could be used with one electrode rod, or two or more such single spider support elements could be used. Further, they may be stacked or connected with one another. In fact, double, triple or other multiple spider support elements may be formed by welding together or otherwise wiring or attaching single spider support elements. Alternatively, a multiple spider support element may be unistructurally formed.

Figure 3:
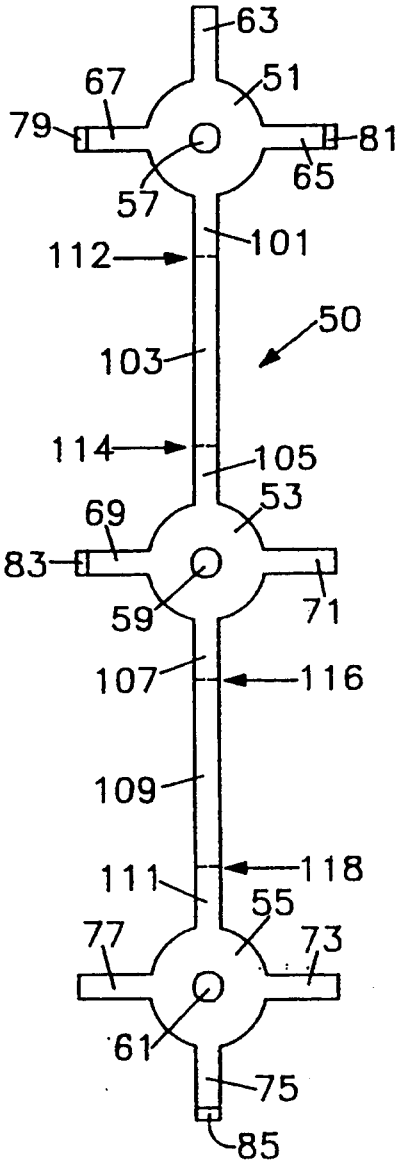
FIG. 3 shows a present invention support element which utilizes three spider members which are formed of a single, unistructural piece of metal and subsequently bent to achieve the desired configurations.
Figure 4:
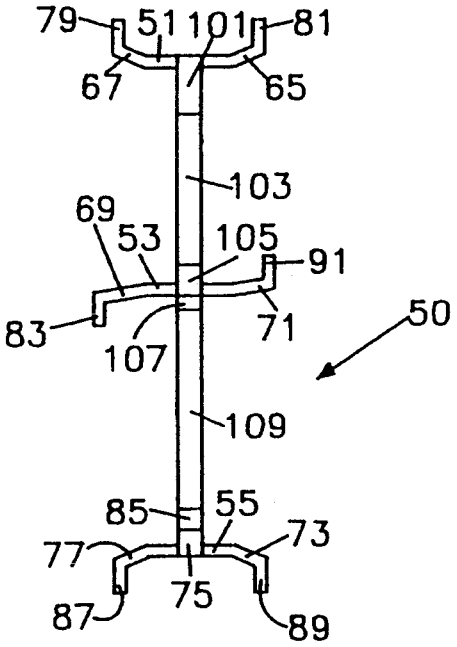
FIG. 4 shows a side view of the present invention support element shown in FIG. 3 but in its fully bent and properly aligned configuration.

Referring to FIGS. 3 and 4, there is shown a unistructurally formed triple spider support element 50. FIG. 3 shows a top view of the unistructural support element in its cut or stamped configuration and FIG. 4 shows a side view of support element 50 after it has been placed into the final configuration and folded or bent as herein described. Triple spider support element 50 has three flat central portions 51, 53 and 55. Each of these flat central portions has a central orifice 57, 59 and 61. The top flat central portion 51 has support element legs 63, 65 and 67, similar to those shown in the FIG. 1 support element 1. Likewise, middle flat central portion 53 has legs 69 and 71 as shown. Finally, bottom flat central portion 55 has legs 73, 75 and 77, as shown. The three flat central portions 51, 53 and 55 have connecting legs. Thus, connecting leg 101 extends from central flat portion 51 into a connection strip 103 and then into connecting leg 105 of flat central portion 53. Likewise, flat central portion 53 has an opposite connecting leg 107 which extends to connection strip 109 and this is connected to connecting leg 111, as shown. Additionally, bending scores are shown as scores 112, 114, 116 and 118.

If support element 50 in its flat form of FIG. 3 were reformed or bent to its final configuration, flat central portion 51 would be bent backwardly so that pods 79 and 81 would face upwardly as shown in FIG. 4. Likewise, flat central portion 53 would be bent backward or inwardly so that pod 83 would be facing downwardly. Finally, flat central portion 55 would be bent upwardly so that pod 85 would also be facing upwardly. This is the side configuration represented in FIG. 4 showing pods 79, 81, 83, 91, 85, 87 and 89.

The multi-spider support element 50 shown in FIGS. 3 and 4 may typically be inserted within the arm of an envelope and support a heavy, rather large, high kilowatt type of short arc discharge lamp. The support element 50 may have as its securing means, any one or number of possibilities. For example, the envelope itself could have securing beads of quartz or glass so as to hold the support element 50 axially, e.g. by suck down of bulb arm. Alternatively, the envelope could have grooves or etches and the pods could extend into such grooves so as to prevent axial movement of support element 50 within an envelope arm. Further, springs tightly wrapped about the electrode rod on which support element 50 may be utilized could prevent movement of the support element with respect to the electrode. Additionally, the geometry of the envelope arm itself could be used to at least prevent downward axial movement of support element 50 as would be the case when support element 50 is approximately equal to the length of the support arm. For very long electrode rods, a collar such as open tubing or something like a ball point pen pocket clip could be used to hold the support element 50 at its desired height up the length of the electrode rod. Other means described above or otherwise could be used to prevent upward axial movement of the support element. Other securing means should now be evident to the artisan without exceeding the scope of the invention.

Figure 5:
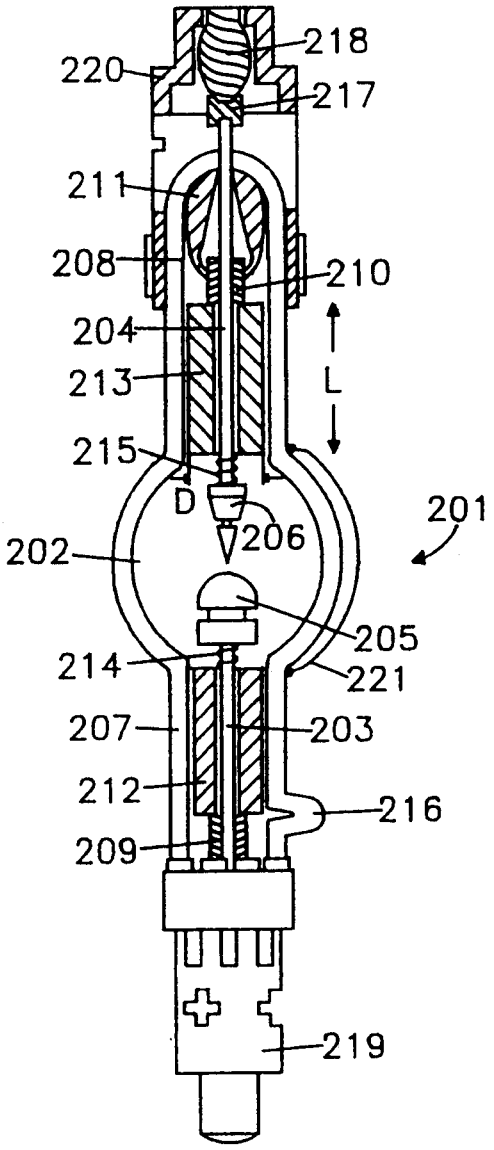
FIG. 5 PRIOR ART
FIG. 5 shows a side cut view of a short arc discharge lamp of the prior art.

FIG. 5 shows a prior art configuration which is described as follows:

The high-pressure discharge lamp 201 shown in FIG. 5 includes a glass enclosure formed by quartz glass to define a generally globular discharge space 202 and cylindrical envelope portions 207 and 208. Extending concentrically within the envelope portions 207 and 208 are electrode rods 203 and 204 carrying, respectively, an anode 205 and a cathode 206 at their inner ends. The outer ends of the electrode rods 203 and 204 are sealed hermetically to the outer ends of the envelope portions 207 and 208. The hermetic seal comprises the glass members 209 and 210, respectively, a dome portion 211 shown only for the cathode electrode, and the ends of the envelope portions 207 and 208.

Support elements, each formed by respective tubular members 212 and 213, are fitted around the electrode rods 203 and 204. The support elements are preferably also formed of quartz glass, but may be formed of a ceramic material, or the like, and have a diameter enabling a small clearance to be maintained between the support elements and the inner surface of the respective envelope portions. These support elements 212 and 213 are urged against the respective glass members 209 and 210 by a retaining element formed as a respective spiral compression spring 214 and 215 preferably formed of the same material as the electrode rods 203 and 204, that is tungsten. These springs 214 and 215 are arranged between the anode 205 and the cathode 206, respectively, and the respective support elements 212 or 213.

The support element 212 has a length L of about 25 mm, and the support element 213 has a length L of about 20 mm, and both support elements have a diameter D of about 7.5 mm. The ratio of the length L to diameter D of the support elements of the embodiment illustrated in FIG. 1 remains substantially constant over the entire length of the support element, that is for the support element 212 on the anode side, this ratio is approximately 3.33; and for the support element 213 on the cathode side, the ratio is approximately 2.67. The electrode rod 204 extends externally from the hermetic seal and is connected by intermediate member 217 to a stranded lead-in wire 218, held in base 220, and base 219 connects an end portion of electrode rod 203 with appropriate electrical connectors. A starting wire 221 is passed along the discharge space 202 on the outside thereof and is wrapped around respective envelope portions 207 and 208. The high pressure discharge lamp of FIG. 5 is typically charged with xenon gas to a pressure of about 10 bar through opening 216 which is later sealed, and is operated from a D.C. source with an input of approximately 500 W.

Support elements 212 and 213 of tile prior art discharge lamp 201 have significant disadvantages and among these is the fragileness of using glass inserts, the problem of occupying substantial space within the arms of the envelope, the containment of xenon primarily in the bulb area and the weight factor which may be involved in larger units. Most significantly, this type of prior art arrangement contains the xenon gases within the bulb position of the envelope and, during usage, sputtering occurs and blackening coats the inside of the bulb. This eventually results in blackening of the bulb to the point where it must be replaced. Further, prior to replacement, such prior art bulbs have decreased illumination due to the gradual buildup of blackening within the bulb portion of the lamp.

Figure 6:
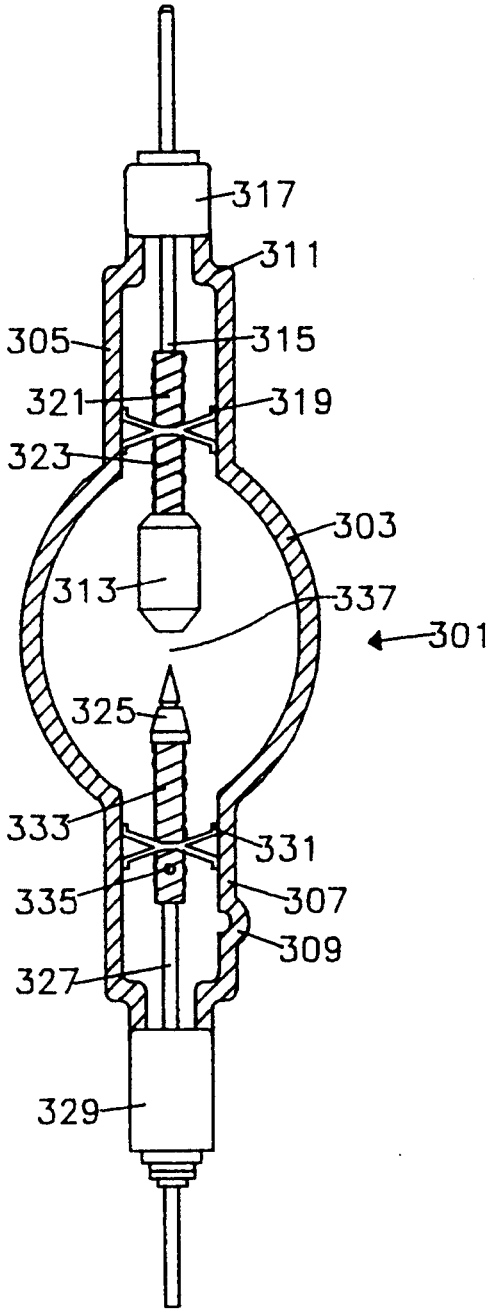
FIG. 6 shows a present invention short arc discharge lamp using single spider support elements for anode and cathode support.

Referring now to FIG. 6, there is shown present invention short arc discharge lamp 301 with bulb portion 303 and envelope arms 305 and 307. Anode 313 is located within the bulb portion 303 and is attached to electrode rod 315 which extends through envelope dome 311 and base 317 and may have additional base covering thereon and attachments for wiring which are conventional and not a point of novelty as to this particular invention. Present invention single spider support element 319 similar to that shown in FIG. 1 is located on electrode rod 315 and has a positioning spring 321 and positioning spring 323 holding it in position to prevent it from sliding axially upwardly or downwardly. Additionally, the pods of single spider support element 319 are directly in contact with the inside surface of arm 305, as shown. Further, cathode 325 is located within bulb portion 303 and is spaced so as to create arc gap 337 between it and anode 313. Cathode 325 is attached to electrode rod 327 and electrode rod 327 extends through base 329 as shown. Single spider support element 331 is mounted on electrode rod 327 and is held in place axially via positioning springs 333 and 335 as shown. Again, the support element is held in position so as to align the electrode rod by virtue of its pods in direct contact with the inside surfaces of the walls of envelope arm 307.

The present invention discharge lamp 301 with the advantageous support elements 319 and 331 allow xenon gas to enter into the full length of the envelope arms 305 and 307 in substantial amounts. As can be seen, xenon gas fed through now sealed fill tube 309 will engulf the entire open volume of the envelope. When discharge lamp 301 is operated, the sputtering which occurs will result in deposition primarily on the quartz surfaces of the arms rather than bulb portion 303 as such deposition occurs at the coolest points within the lamp. This allows the lamp of the present invention, discharge lamp 301, to operate brighter and also longer than conventional prior art lamps. Thus, the present invention lamp and present invention support elements create the synergistic effects of decreasing weight, decreasing likelihood of breakage and, at the same time reducing the problems created by sputtering as well as extending the useful life of the lamps and having the lamps operate with more light passing therethrough, i.e. with greater illumination.

Figure 7:
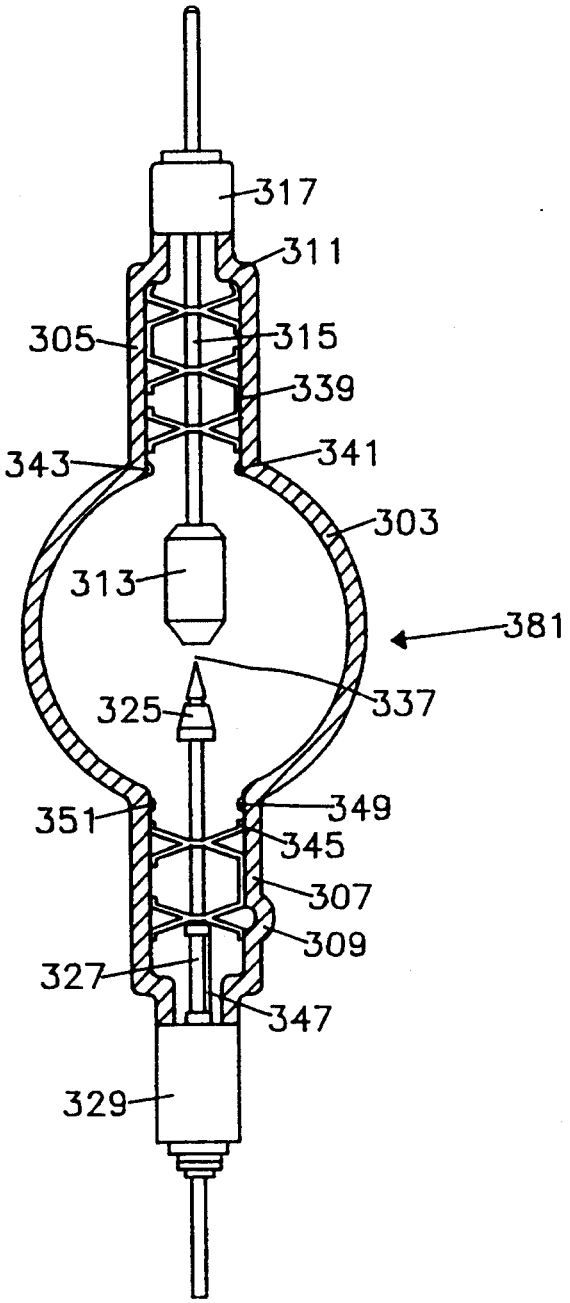
FIG. 7 shows another embodiment of the present invention utilizing multiple spider support elements; and, FIGS. 8 and 9 show a top view and a side cut view of a modified version of the support element shown in FIGS. 1 and 2.

FIG. 7 shows an alternative embodiment of the present invention where discharge lamp 381 is similar to present invention lamp 301 and all like parts are like numbered. However, in this embodiment, a triple spider support element 339 similar to that shown in FIGS. 3 and 4 is utilized with anode 313's electrode rod 315. By virtue of the length of triple spider support element 339, the dome 311 prevents downward movement and upward movement axially is prevented by virtue of securing beads 341 and 343.

Double spider support element 345 is likewise axially secured upwardly by means for securing the support element which are the same as those for the triple spider support element 339, that is, securing beads. In this case, securing beads 349 and 351 are utilized. However, as mentioned above, grooves within the envelope arm could effectively secure double spider support element 345. Downward movement axially is prevented by a securing collar 347 which is merely formed of two rings and a vertical portion and this is pre-designed for a specific, desired length so as to retain the support element 345, as shown. The advantages here are similar to those achieved in the present invention lamp 301 described above.

The rise of the multiple spider supports of the present invention are particularly useful in supporting heavy units, as in the case where some anode heads weigh as much as 14 to 16 ounces or more. Quartz supports such as are found in the prior art may crack an do crack during shipping of such lamps. Unobserved cracks result in utilization of lamps which may explode during use from Thermal expansion. These problems are eliminated by the present invention.

Figure 8:
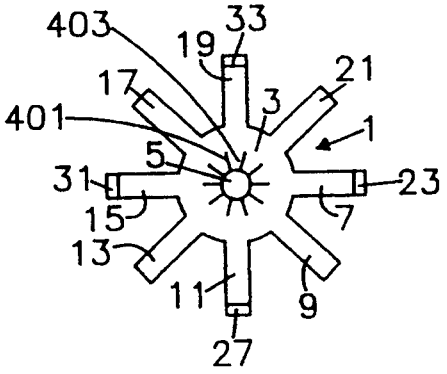
Figure 9:
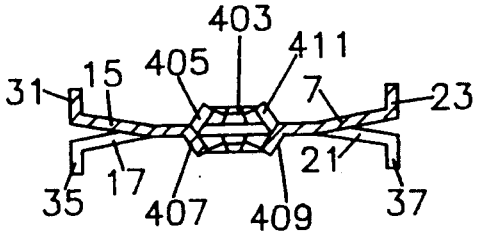

Referring now to FIGS. 8 and 9, a top view and a side art view of a single spider support device such as is shown in FIGS. 1 and 2, are represented in a modified version. Here, all parts and sections identical to those in FIGS. 1 and 2 are identically numbered as in FIGS. 1 and 2. However, at central orifice 5, a series of cuts, represented by cut 401, have been made to create central strips such as strip 403, 405, 407, 409, and 411 are representative and are bent upwardly and downwardly in an alternating fashion. These bent central strips may now function as the mean for securing the support element within an envelope arm by "pinching" an electrode rod of an appropriate diameter. Thus, in this embodiment, the means for securing the support element is an integral part of the support element itself.

Another alternative support means could encompass grooves with an electrode arm with rings, washers on the like "snapped" into the grooves to secure the support elements or bound into the grooves for this purpose, e.g. molybdenum wire may be soldered into grooves.

Obviously, numerous modifications and variations of the present invention are possible in light of the above teachings. It is therefore understood that within the scope of the appended claims, the invention may be practiced otherwise than as specifically described herein.

What we claim is:

1. In a short arc discharge lamp having a quartz envelope with a bulbous portion and a plurality of envelope arms having an inside surface and a cross-section, and wherein one or more electrode rods are supported within said lamp for specific alignment, the support elements for said electrode rods being the improvement which comprises:

a. a support element comprising a high temperature metal, and having a unistructural design, and having a flat central portion with a central orifice of sufficient dimension to receive said electrode rods, and having a multiplicity of legs radially extending upwardly and downwardly from said flat central portion to form an angle with said flat central portion, each leg has an end portion terminating with a pod formed at substantially a right angle to said flat central portion, said legs are of sufficient length to fit said support element within the cross-section of said envelope arms so that said pods contact the inside surface of said envelope; and b. securing means for securing said support element within an envelope arm.

2. The short arc discharge lamp of claim 1, wherein one or more of said pods project upwardly at a right angle to said flat central portion, and one or more of said support element pods projects downwardly at a right angle to said flat central portion.

3. The short arc discharge lamp of claim 1, wherein said angle formed by said legs and said flat central portion is less than 30°.

4. The short arc discharge lamp of claim 1, wherein said securing means comprises said envelope arm having geometry to prevent axial movement of said support element.

5. The short arc discharge lamp of claim 1, wherein said securing means comprises grooves on said envelope arms having adequate dimensions to receive said pods.

6. The short arc discharge lamp of claim 1, wherein said securing means comprises one or more beads on said envelope arm having adequate size to support said pods.

7. The short arc discharge lamp of claim 1, wherein said securing means comprises one or more springs wound about said electrode rod.

8. The short arc discharge lamp of claim 1, wherein said support element is made substantially of molybdenum.

9. The short arc discharge lamp of claim 1, wherein said supporting element comprises connecting legs and a connecting strip for connecting two or more central flat portions, said connecting legs radially extend from said central flat portions, said connecting strip runs substantially perpendicular to said central flat portions, said connecting legs connect to said connecting strip such that said central orifice of each central portion align.

10. A short arc discharge lamp comprising:

a. a quartz envelope with a bulbous portion and a plurality of arms having a specified cross-section;

b. two or more electrodes spaced apart from one another within said envelope so as to create a short arc discharge space between them and within said bulb;

c. an electrode rod connected to each of said electrodes, being within said envelope and extending away from said space and into said envelope arms;

d. a support element comprising a high temperature metal, and having a unistructural design, and having a flat central portion with a central orifice of sufficient dimension to receive said electrode rods, and having a multiplicity of legs radially extending upwardly and downwardly from said flat central portion to form an angle with said flat central portion, each leg has an end portion terminating with a pod formed at substantially a right angle to said flat central portion, said legs are of sufficient length to fit said support element within the cross-section of said envelope arms so that said pods contact the inside surface of said envelope; and, e. securing means for securing each said support element within the envelope arms.

11. The short arc discharge lamp of claim 10, wherein one or more of said pods project upwardly at a right angle to said flat central portion, and one or more of said support element pods projects downwardly at a right angle to said flat central portion.

12. The short arc discharge lamp of claim 10, wherein said angle formed by said legs and said flat central portion is less than 30°.

13. The short arc discharge lamp of claim 10, wherein said securing means comprises said envelope arm having geometry to prevent axial movement of said support element.

14. The short arc discharge lamp of claim 10, wherein said securing means comprises grooves on said envelope arms having adequate dimensions to receive said pods.

15. The short arc discharge lamp of claim 10, wherein said securing means comprises one or more beads on said envelope arm having adequate size to support said pods.

16. The short arc discharge lamp of claim 10, wherein said securing means comprises one or more springs wound about said electrode rod.

17. The short arc discharge lamp of claim 10, wherein said support element is made substantially of molybdenum.

18. The short arc discharge lamp of claim 10, wherein said supporting element comprises connecting legs and a connecting strip for connecting two or more flat central portions, said connecting legs radially extend from said flat central portions, said connecting strip runs substantially perpendicular to said flat central portions, said connecting legs connect to said connecting strip such that said central orifice of each central portion align.

19. The short arc discharge lamp of claim 18, wherein said support element has at least three flat central portions of which at least one is a middle flat central portion, two connecting at least one is a middle flat central portion, two connecting legs extend in opposite directions from said middle flat central portion.

* * * * *